US007967928B2

(12) United States Patent
Luo et al.

(10) Patent No.: US 7,967,928 B2
(45) Date of Patent: Jun. 28, 2011

(54) METHODS OF EXTRUDING MAGNESIUM ALLOYS

(75) Inventors: Aihua A Luo, Troy, MI (US); Anil K Sachdev, Rochester, MI (US)

(73) Assignee: GM Global Technologies Operations LLC, Detroit, MI (US)

( * ) Notice: Subject to any disclaimer, the term of this patent is extended or adjusted under 35 U.S.C. 154(b) by 939 days.

(21) Appl. No.: 11/865,415

(22) Filed: Oct. 1, 2007

(65) Prior Publication Data

US 2008/0017286 A1 Jan. 24, 2008

Related U.S. Application Data

(63) Continuation-in-part of application No. 10/793,412, filed on Mar. 4, 2004, now abandoned.

(51) Int. Cl.
*C22F 1/06* (2006.01)

(52) U.S. Cl. ..... 148/667

(58) Field of Classification Search ..... 148/667; 420/410

See application file for complete search history.

(56) References Cited

U.S. PATENT DOCUMENTS

| | | | | |
|---|---|---|---|---|
| 2,023,498 | A | 12/1935 | Winston | |
| 4,997,622 | A | 3/1991 | Regazzoni et al. | |
| 5,147,603 | A * | 9/1992 | Nussbaum et al. | 420/409 |
| 6,322,644 | B1 | 11/2001 | Pekguleryuz et al. | |
| 6,455,100 | B1 | 9/2002 | Heimann et al. | |
| 6,471,797 | B1 | 10/2002 | Kim et al. | |
| 6,793,877 | B1 | 9/2004 | Pettersen et al. | |
| 7,140,224 | B2 | 11/2006 | Luo et al. | |
| 7,237,418 | B2 * | 7/2007 | Maeno et al. | 72/269 |
| 2002/0020475 | A1 | 2/2002 | Sakamoto et al. | |
| 2002/0102179 | A1 | 8/2002 | Murai et al. | |

FOREIGN PATENT DOCUMENTS

| | | | |
|---|---|---|---|
| DE | 10230275 | A1 | 1/2004 |
| EP | 945199 | B1 | 3/1999 |
| JP | 2002266057 | A | 9/2002 |
| WO | WO 01/02614 | | 1/2001 |

OTHER PUBLICATIONS

"ASM vol. 2 Properties and Selection: Nonferrous Alloys and Special Purpose Materials," Properties of Magnesium Alloys, ASM International (2002), pp. 1-3.

* cited by examiner

*Primary Examiner* — Roy King
*Assistant Examiner* — Janelle Morillo
(74) *Attorney, Agent, or Firm* — Harness, Dickey & Pierce, P.L.C.

(57) ABSTRACT

Methods of extruding magnesium-based casting alloys are provided. The magnesium alloys have relatively high strength and castibility, as well as an improved ductility and extrudability for wrought alloy applications. The magnesium-based wrought alloy comprises aluminum (Al) of between about 2.5 to about 3.5 wt. %, manganese (Mn) of less than about 0.6 wt. %, zinc (Zn) of less than about 0.22 wt. %, other impurities of less than about 0.1 wt. %, and a balance of magnesium (Mg). The disclosure provides various methods of forming extruded structural components, including automotive components, and methods of forming such wrought alloys.

24 Claims, 11 Drawing Sheets

METHODS OF EXTRUDING MAGNESIUM ALLOYS

CROSS-REFERENCE TO RELATED APPLICATIONS

This application is a continuation-in-part of U.S. patent application Ser. No. 10/793,412, filed Mar. 4, 2004, now abandoned. The disclosure of the above application is incorporated herein by reference in its entirety.

FIELD

The present disclosure relates to methods of forming extruded metal components and more particularly to methods of making extruded metal structural components from magnesium-based metal alloy compositions.

BACKGROUND

Magnesium-based alloys are generally classified into two distinct categories, cast or wrought alloys. Both types of alloys are in widespread use throughout many industries, including in the automotive industry. Magnesium-based alloy cast parts can be produced by conventional casting methods which include die-casting, sand casting, permanent and semi-permanent mold casting, plaster-mold casting and investment casting. Cast parts are generally formed by pouring a molten metal into a casting mold that provides shape to the molten material as it cools and solidifies. The mold is later separated from the part after solidification.

Cast alloy materials demonstrate a number of particularly advantageous properties that have prompted an increased demand for magnesium-based alloy cast parts in the automotive industry. These properties include low density, high strength-to-weight ratio, easy machinability and good damping characteristics. However, many of the compositions for casting alloys are not particularly well-adapted to use as a wrought alloy, where the alloy material is further worked by a deformation process after solidification. Further, many of the commercially available wrought magnesium-based alloys are not comparable to the performance capabilities of other metal wrought alloys (e.g., aluminum-based or stainless steel alloys). Therefore, there is a need for an improved magnesium-based alloy suitable for wrought alloy applications.

SUMMARY

In various aspects, the present disclosure provides a method of forming an extruded structural component that comprises extruding a magnesium alloy material through a die orifice. In certain aspects, the extruding forms a tubular component. In certain aspects, the extruding further comprises passing the magnesium alloy material through a die bridge and then through a die orifice. The magnesium alloy material is capable of an extrusion speed of greater than or equal to about 305 mm per minute at about 360° C. Further, the alloy material has a composition comprising aluminum (Al) at about 2.5 to about 3.5 wt. %; manganese (Mn) at about 0.2 to about 0.6 wt. %; zinc (Zn) less than an impurity level of 0.22 wt. %; one or more impurities other than zinc (Zn) collectively less than about 0.1 wt. %; and a balance of magnesium (Mg). The extruding forms an extruded structural component, which has a yield strength of at least about 150 MPa and an elongation of greater than or equal to about 10% at room temperature. In certain aspects, the extruding is conducted at a temperature less than a recrystallization temperature of the magnesium alloy material and the extruding results in strain hardening of the extruded structural component.

In certain aspects, the present disclosure provides a method of forming an extruded structural component comprising extruding a magnesium alloy material through a die orifice. The magnesium alloy material is capable of an extrusion speed of greater than or equal to about 305 mm per minute at about 360° C. and the alloy has a composition comprising aluminum (Al) at about 2.5 to about 3.5 wt. %; manganese (Mn) at about 0.2 to about 0.6 wt. %; zinc (Zn) at less than an impurity level of about 0.22 wt. %; one or more impurities other than zinc (Zn) collectively less than about 0.1 wt. %; and a balance of magnesium (Mg) to form the extruded structural component. The method forms an extruded structural component which has an ultimate tensile strength greater than or equal to about 230 MPa and a yield strength of greater than or equal to about 150 MPa at room temperature.

In yet other aspects of the present disclosure, a method is provided for forming an extruded structural component comprising extruding a magnesium alloy material preform having a first diameter through a die orifice with a second diameter that is less than the first diameter at an extrusion ratio of greater than or equal to about 4. The alloy material preform is at a temperature of less than or equal to about 200° C. and is capable of an extrusion speed of greater than or equal to about 305 mm per minute at about 360° C. The alloy composition comprises aluminum (Al) at about 2.5 to about 3.5 wt. %; manganese (Mn) at about 0.2 to about 0.6 wt. %; zinc (Zn) at less than an impurity level of about 0.22 wt. %; one or more impurities other than zinc (Zn) collectively less than about 0.1 wt. %; and a balance of magnesium (Mg) to form the extruded structural component having the second diameter. Further, the extruded structural component has a yield strength of at least about 150 MPa, and an elongation of greater than 12% at room temperature.

In yet other aspects, the present disclosure provides a method of forming an extruded tubular automobile component that comprises extruding a magnesium alloy material through a reduced diameter die orifice having a shape that forms a tubular component for use in an automobile at an extrusion ratio greater than or equal to about 4. The magnesium alloy material is capable of an extrusion speed of greater than or equal to about 305 mm per minute at about 360° C. The alloy material has a composition comprising aluminum (Al) of about 3.0 wt. %; manganese (Mn) at about 0.2 to about 0.6 wt. %; zinc (Zn) less than an impurity level of about 0.18 wt. %; one or more impurities other than zinc (Zn) collectively less than about 0.1 wt. %; and a balance of magnesium (Mg) to form the extruded tubular automotive structural component having a yield strength of at least about 150 MPa, an ultimate tensile strength of at least about 230 MPa, and an elongation of greater than 12% at room temperature.

In yet another aspect, the present disclosure provides a method of forming a wrought alloy element comprising: forming a molten alloy material having a composition comprising aluminum (Al) of greater than or equal to about 2.5 wt. % and less than or equal to about 3.5 wt. %; manganese (Mn) and zinc (Zn) collectively present at less than about 1.0 wt. %; one or more impurities collectively less than about 0.1 wt. %; and a balance of magnesium (Mg), at a casting temperature. The alloy material is cooled to solidify. The solidified alloy material is processed by extruding, thereby forming the wrought extruded alloy element.

Further areas of applicability of the present disclosure will become apparent from the detailed description provided hereinafter. It should be understood that the detailed description and specific examples, while indicating the various aspects of the disclosure, are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
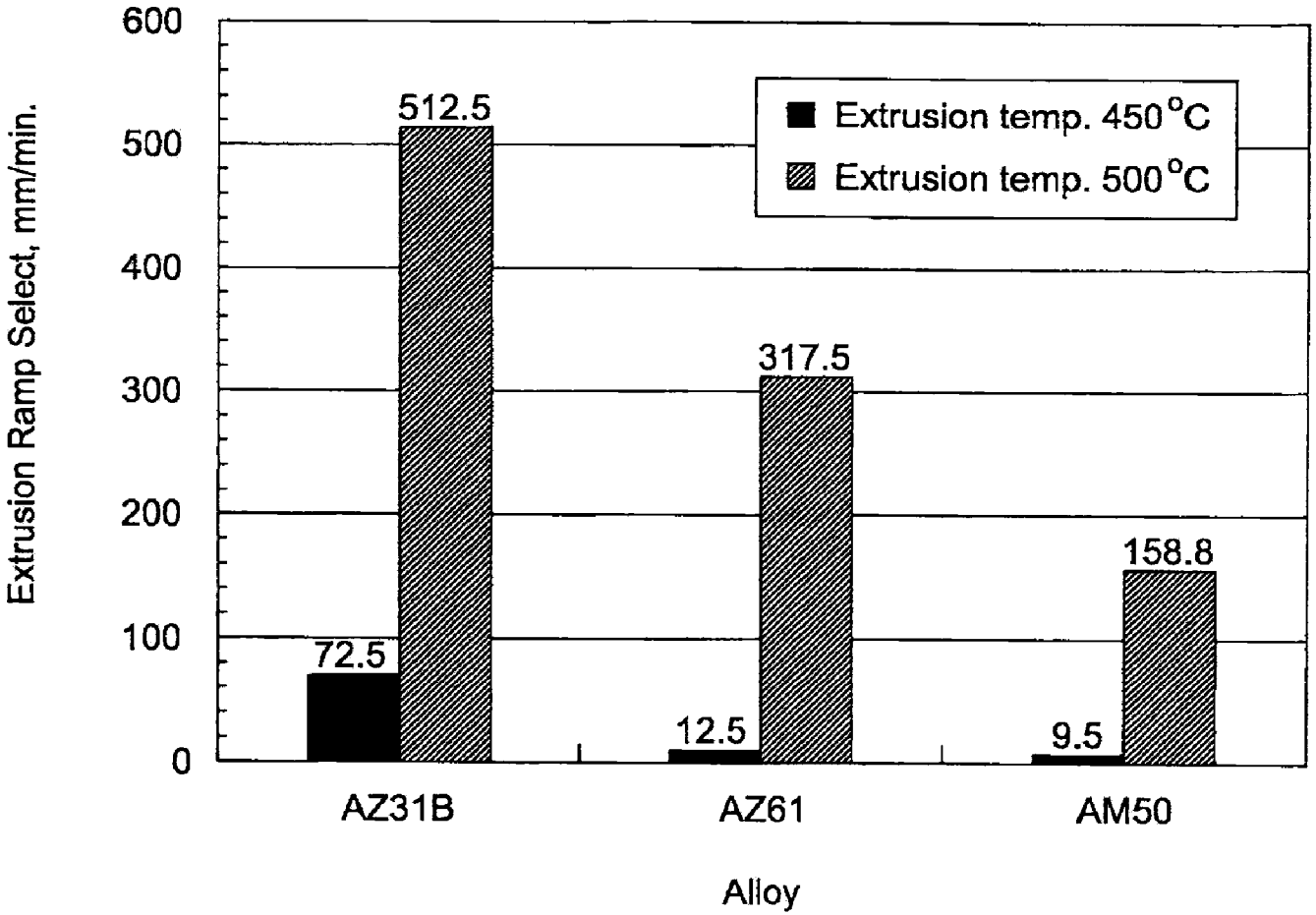
FIG. 1 is a chart showing maximum extrusion speeds of prior art alloys.

The following description of the various aspects of the present disclosure is merely exemplary in nature and is in no way intended to limit the invention, its application, or uses.

In various aspects, the present disclosure provides methods of extruding a strong, corrosion-resistant, and lightweight magnesium-based alloy. By "magnesium-based" it is meant that the composition is primarily comprised of magnesium, generally greater than 80 wt. % magnesium. As used herein, the term "composition" refers broadly to a substance containing at least the preferred metal elements or compounds, but which may also comprise additional substances or compounds, including additives and impurities. The term "material" also broadly refers to matter containing the preferred compounds or composition. The present disclosure further relates to methods of making preferred embodiments of the magnesium-based alloy, as well as to methods of making components with preferred embodiments of the inventive alloy.

In another aspect, the present disclosure provides methods of forming extruded structural components by using a wrought magnesium-based alloy, which is designed for improved extrudability and formability, while still maintaining strength and corrosion resistance appropriate for structural components. As used herein, the terms "wrought" and "worked" are synonymous and refer to an alloy that is generally processed in two separate steps, as recognized by one of skill in the art. The first step comprises forming molten metal into a preform, also referred to as an ingot, billet, or stock. The preform formed in the first step is then processed by working the preform in a second step, thereby forming a wrought product. The preform thus undergoes a physical deformation process in the second step, such as extrusion, for example. The wrought product can then be used to form a part or a portion of a part. The principles of the present teachings are particularly suitable for use in an extrusion process.

"Extrusion" as used herein is a type of metal-forming or working process where a metal preform (e.g., metal ingot or billet) is forced to flow plastically through an extrusion die orifice by relatively large compression forces to form an extruded component having a length and a desired shape with a reduced cross-sectional area as compared to the original cross-sectional area of the metal preform before processing. The extrusion process generally forms a component having a uniform shape and cross-section. During extrusion, the metal preform is passed through the die orifice by a ram applying pressure thereto, for example.

Thus, in accordance with various aspects of the present teachings, the alloy material is then processed by a deformation process, preferably extrusion, which thereby forms the wrought alloy element. Such deformation processing of the alloy material may include a hot-working process, a cold-working process, or both. Hot-working processes generally refer to deformation processes where a metal is plastically deformed at such temperatures and strain rates that recrystallization takes place simultaneously with the plastic deformation, thus avoiding strain hardening. Strain hardening is generally understood to be an increase in strength and hardness caused by plastic deformation at temperatures below the recrystallization range of the metal. However, when strain hardening occurs, it generally reduces a metal's ductility.

The principles of the present disclosure are particularly applicable to processes that involve "cold extrusion" or "cold-working" of metal alloys, which are those processes where the metal stock or preform enters the extrusion die at a temperature below the recrystallization temperature of the alloy and is then subjected to a strain rate that induces strain-hardening. As the alloy passes through the extrusion die, the alloy generally undergoes a subsequent rise in temperature due to the thermo-mechanical effects of plastic deformation and friction as the metal stock passes through the orifice of the die via compressive force and plastic deformation of the metal. Cold-working deformation processes are generally conducted at lower temperatures, generally below 200° C., optionally at ambient temperatures. However, the wrought alloy temperature may increase locally due to the plastic deformation and frictional forces encountered.

"Casting," as it is generally known, involves pouring a molten metal alloy into a casting mold to essentially form a solidified cast part in a near-finished state. The molten metal alloy is poured into a mold, where the metal alloy solidifies after cooling, to form a cast part. The physical requirements for cast alloys are different from the requirements for wrought alloys, due to the differences in physical processing. Thus, while a wrought alloy is first, in essence, cast as an ingot or preform, it must also further withstand the additional physical deformation and corresponding processing conditions. Further, the material properties that are desirable for extrusion processes are unique in that the material must have sufficient ductility and strength hardening while being capable of high extrusion speeds without exhibiting defects or cracking and, ultimately forming a component that has a high structural strength, as will be discussed in more detail below. Hence, many alloys suitable for casting or even certain types of working are unsuitable or undesirable for extrusion, because extrusion requires additional optimization of a greater variety of physical properties than those properties needed for a cast alloy, such as higher ductility, extrudability and formability, while still having sufficient strength and castability to withstand the initial casting process and to form strong structural components.

Reducing the weight of components in parts assemblies is important for improving efficiency in many different applications, but becomes of great importance for fuel efficiency in mobile applications, such as in automobiles. For example, current magnesium parts are generally made by die casting due to the high productivity and good castability of magnesium alloys. However, many metal parts can be made of wrought alloys for any given application, which can further improve efficiency. For example, tubular sections of steel and aluminum alloys are increasingly used in the automotive industry to replace stamped components, which potentially translates to weight savings, part consolidation, and improved vehicle performance. Such tubular structural components can be used to form various support structures, such as truck frames, engine cradles, roof rails, cross-member supports, and instrument panel beams. In various aspects of the present disclosure, such tubular components are made via an extrusion process.

In various aspects of the invention, extruded components can be formed by employing magnesium-based alloys which are relatively low cost lightweight alloys that demonstrate improved ductility and extrudability, while maintaining relatively high strength and castability through a range of temperatures. (e.g., between ambient temperatures of approximately 26° C. to about 200° C.). The magnesium-based alloys of the present disclosure are particularly well suited to wrought alloy applications and specifically for extrusion processing. Further, the inventive alloys are also corrosion resistant. As a result of such properties described above, the magnesium-based alloys are suitable for use in a wide variety of applications including various automotive structural components such as, for example, frames, support members, cross-members, instrument panel beams, roof rails, engine cradles, transfer cases, and steering components.

Various embodiments of the present methods include forming extruded components with a particularly desirable magnesium alloy that contains aluminum as an alloying element, which is generally believed to have a favorable effect on the physical properties of a magnesium alloy. Aluminum generally improves strength and hardness of a magnesium-based alloy, but it reduces the overall ductility. Generally, increasing aluminum content (i.e., above about 5 wt. %) widens the freezing range for the magnesium-based alloy, which makes it easier to cast. However, there is a trade off because an increased aluminum content makes the alloy more difficult to subsequently work, due to an increased hardness. Furthermore, an aluminum content that is too low provides an alloy that lacks sufficient strength for use in making structural components.

Thus, one aspect of the present disclosure includes using a magnesium alloy that optimizes the aluminum content to maximize the ductility and extrudability, while maintaining reasonable yield strength and ultimate tensile strength, as well as suitable properties for castability (for billet casting prior to working or extrusion). Thus, in certain embodiments, the present alloys comprise an aluminum content of about 3% by weight. In certain aspects, the aluminum content is greater than or equal to about 2.5 wt. % and less than or equal to about 3.5 wt. % in order to optimize the alloy properties during extrusion, as will be discussed in greater detail below. "About" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates a possible variation of up to 5% of the indicated value of 5% variance from usual methods of measurement. For example, a component of about 10 wt. % could vary between 10±0.5 wt. %, thus ranging from between 9.5 and 10.5 wt. %. Certain embodiments of the present disclosure comprise an aluminum content of greater than or equal to about 2.5 to about 3.5 wt. %, optionally about 2.75 wt. % to about 3.25 wt. %, optionally about 2.9 wt. % to about 3.1 wt. %, and in certain aspects preferably 3 wt. %, to optimize the strength and extrudability.

Further, various embodiments of the present disclosure comprise manganese as an alloying ingredient present at less than about 0.6 wt. %. While manganese does not appear to have a large impact on tensile strength of a magnesium-based alloy, it does increase yield strength of the magnesium alloys. Further, manganese functions to improve corrosion resistance of a magnesium aluminum alloy system, by facilitating removal of iron and other heavy metal elements into relatively inert intermetallic components, some of which separate out of the alloy during melting. In various embodiments of the present disclosure, the alloy comprises manganese of about 0.2 to about 0.6 wt. %, and most preferably from about 0.26 to about 0.6 wt. %. In one aspect of the present disclosure, manganese is added at about 0.4 wt. %, as recommended by ASTM Specification B93-94a.

The magnesium alloys for use with the methods of the present disclosure preferably limit the zinc content to an impurity level. In certain aspects of the present disclosure, the alloy comprises zinc as an impurity at less than about 0.3 wt. %, preferably less than about 0.22 wt. %, more preferably less than about 0.2 wt. %, preferably less than about 0.18 wt. %, and most preferably less than or equal to about 0.16 wt. % of zinc. Zinc has typically been used as an alloying ingredient to strengthen magnesium-based alloys of the prior art; however, such alloys typically have significantly lower extrudability, ductility, and increased hot-shortness. Further, zinc-containing magnesium alloy systems are generally prone to micro-porosity, and the zinc has been reported to increase surface cracking and oxidation of Mg—Al—Zn based alloys during extrusion, resulting in lower extrusion speed limits. Thus, in contrast to known wrought magnesium alloy systems, the present disclosure employs a magnesium alloy that minimizes the amount of zinc present to an impurity level, as described above.

A currently available wrought magnesium alloy is known as AZ31B (which per ASTM designation is a magnesium-based alloy having a composition of approximately 3 wt. % aluminum (Al), 1 wt. % zinc (Zn), and the balance magnesium and impurities, which is commonly expressed in the format: Mg-3 wt. % Al-1 wt. % Zn). While the AZ31B provides a suitable combination of mechanical properties and extrudability from the wrought magnesium alloys that are currently available, such wrought alloys generally have relatively poor extrudability and formability compared to available aluminum extrusion alloys, for example. Moreover, commercially available magnesium-based wrought alloys often do not have the strength and structural integrity for use in an extrusion process to form extruded components.

AZ31B has one of the fastest extrusion rates among known wrought magnesium-based alloys. Upon evaluation of the known wrought alloys, the performance of the AZ31B (which has a composition of about 3.0 wt. % Al, about 1.0 wt. % Zn, about 0.20 wt. % Mn and the balance Mg and impurities) was compared to the performance of another known wrought alloy, AZ61, (which has a composition of about 5.0 wt. % Al, about 0.30 wt. % Mn, and the balance Mg and impurities) and to a known cast magnesium-based alloy, AM50 (which has a composition of about 5 wt. % Al, about 0.30 wt. % Mn, and the balance Mg and impurities). Such cast alloys are not generally known to be useful for wrought alloy applications.

FIG. 1 shows a comparison of the extrusion speeds for prior art alloys: AZ31B, AZ61, and AM50 at extrusion temperatures of 450° C. and 500° C., respectively, for 25.4 mm×25.4 mm square tubes with 5 mm walls, with an extrusion ratio of 12.5. As can be observed from the data, the AZ31B has a much higher extrusion speed compared with either the AZ61 or with the cast alloy AM50. The removal of zinc from the AM50 alloy composition aside from small levels of impurities (by using the cast alloy AM50), did not appear to increase the extrusion speed at all, and further provided the lowest extrudability rate, demonstrating generally the poor performance of cast alloy compositions in wrought alloy applications.

Various embodiments of the present disclosure employ methods of forming extruded structural components that employ certain magnesium alloy compositions that optimize aluminum content, by providing a sufficient amount of aluminum for strength and castability, while still minimizing the aluminum content to avoid detrimental impact on the ductility and extrudability of the wrought alloy. In accordance with the results of the comparison made in FIG. 1, one aspect of the present disclosure is a method that uses a novel magnesium-based alloy having an optimized aluminum content of greater than or equal to about 2.5 to about 3.5 wt. %, optionally about 2.75 wt. % to about 3.25 wt. %, optionally about 2.9 wt. % to about 3.1 wt. %, with a particularly preferred aluminum content of about 3 wt. %.

Thus, in accordance with the principles discussed above, a magnesium-based alloy may be used to form structural components by an extrusion process, where the alloy comprises aluminum (Al) at 2.5 wt. % to 3.5 wt. %; manganese (Mn) and zinc (Zn) collectively present at less than 1.0 wt. % where Zn is limited to less than an impurity level; one or more additional impurities collectively less than 0.1 wt. %; and a balance of magnesium (Mg). In particular embodiments, the Mn is present at less than about 0.6 wt. % and Zn is present at less than an impurity level. While an impurity level varies depending on the raw materials employed to form the magnesium-based alloy, an impurity level is generally less than or equal to about 0.22 wt. %, optionally less than or equal to about 0.2 wt. %, preferably at less than or equal to about 0.18 wt. %, optionally less than or equal to about 0.16 wt. %, for example, desirably ranging from about 0 wt. % to about 0.16 wt. %.

A particularly suitable alloy for use in conjunction with the disclosed methods comprises aluminum (Al) at about 3 wt. %; manganese (Mn) at about 0.4 wt. %; zinc (Zn) of less than an impurity level of about 0.2 wt. %; one or more impurities other than zinc (Zn) at less than about 0.1 wt. %, with a balance of magnesium (Mg). This embodiment of the inventive alloy may be nominally represented by the ASTM formula for magnesium alloys, as "AM30." In certain aspects, such magnesium-based alloys comprise a magnesium-based alloy which also contains standard levels of impurities (other than zinc discussed above) that are commonly found in magnesium alloys, such as, silicon (Si), copper (Cu), nickel (Ni), iron (Fe), calcium (Ca), silicon (Si), strontium (Sr), as optionally other trace impurities. In various embodiments of the present disclosure, the additional impurities collectively comprise less than a maximum of about 0.1 wt. % of the alloy. In alternate aspects of the present disclosure, the alloy comprises the following impurities: less than about 0.01 wt. % Si, less than about 0.01 wt. % Cu, less than about 0.002 wt. % Ni, less than about 0.002 wt. % Fe, and less than 0.02 wt. % of all other trace impurities including Ca, Sr, and other common metal contaminants.

Figure 7:
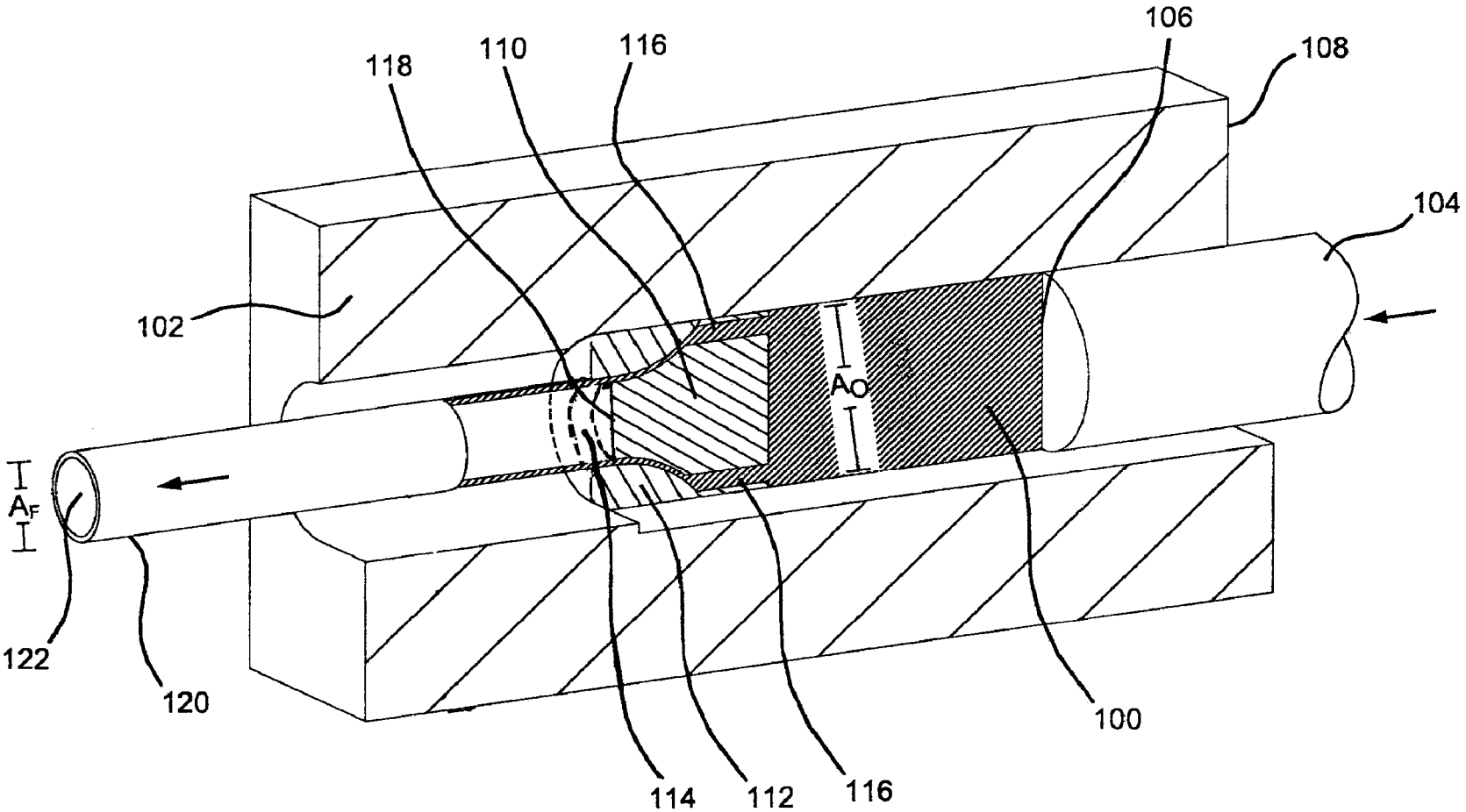
FIG. 7 shows a simplified metal direct extruder for forming a tubular component in accordance with certain aspects of the present disclosure having a die and a bridge die.

In various aspects, the invention provides methods of forming an extruded structural component comprising extruding a magnesium alloy material through a die orifice. A simplified direct extrusion process is shown in FIG. 7. A heated billet or preform 100 is cut from cast log or alternately, for relatively small diameter extrusions, from a larger extruded bar. The preform 100 is optionally located in a die container 102, which may be heated to 450° C. to about 500° C., where the flow stress of magnesium alloys is relatively low. Alternately, the preform 100 is extruded at ambient temperatures (e.g., cold extrusion). As discussed above, the extrusion process is preferably conducted in a cold-working regime, where the temperatures of the die and preform are lower than a recrystallization temperature of the alloy. While a higher temperature generally provides a more rapid extrusion rate, it also promotes higher dynamic recrystallization. Where a relatively lower temperature is employed during extrusion, there is more time for slower and uniform grain development due to slower dynamic recrystallization rates during plastic deformation, which is desirable for strain hardening. As such, in certain aspects, it is desirable to conduct the extruding at less than or equal to a temperature of about 440° C. (reflecting a temperature of the preform prior to encountering friction forces in the die container), optionally less than or equal to about 400° C., optionally less than or equal to about 380° C. In certain aspects, the extruding is conducted at a temperature of about ambient (approximately 26° C.) to about 380° C., optionally from about 350° C. to about 380° C.

Thus, as shown in FIG. 7, pressure is applied by a ram 104 to a first end 106 of the preform 100, so that solid metal flows (e.g., via plastic flow) through the die container 102 disposed within a die block 108. Hollow components can be formed by forcing the metal preform 100 around a mandrel or other solid piece to form a hole in the extruded component. While hollow magnesium extrusions can be made with such a mandrel and a drilled or pierced billet, in various aspects of the disclosure, a bridge die is used, where the metal stream is split into several streams, which subsequently recombine as they pass through a die orifice before exiting the die container. As shown in FIG. 7, the die container 102 includes an extrusion die bridge 110 and a die 112 with an orifice 114 through its central region. The die 112 and die bridge 110 are optionally formed of steel. The cross-sectional shape of the extruded component is defined by the shape of the die orifice 114. The preform 100 has a first cross-sectional area (designated by a cross-sectional area $A_O$ in FIG. 7) and after exiting the die 112 forms an extruded component having a second reduced cross-sectional area $A_F$, which proportionally reduced from the original cross-sectional area $A_O$ of the preform 100. The die bridge 110 forms a plurality of orifices 116 when seated within the die container 102. The die bridge 110 has a solid mandrel section 118. The ram 104 pushes the preform 100 past the die bridge 110 through the die bridge orifices 116 and around the mandrel section 118, where the flowing metal is separated into a plurality of streams corresponding to the respective orifices 116. After exiting the die bridge 110, the streams of metal encounter the orifice 114 of the die 112, where the streams rejoin to form an integral solid piece 120 (having a cross-sectional shape corresponding to the die 110 with a corresponding inner hole 122 formed by the mandrel 118) to form a hollow extruded tube. As appreciated by those of skill in the art, the quantity, design, and positioning of dies and die bridges for extrusion are not limited to those described herein, but include a variety of different configurations.

Figure 8:
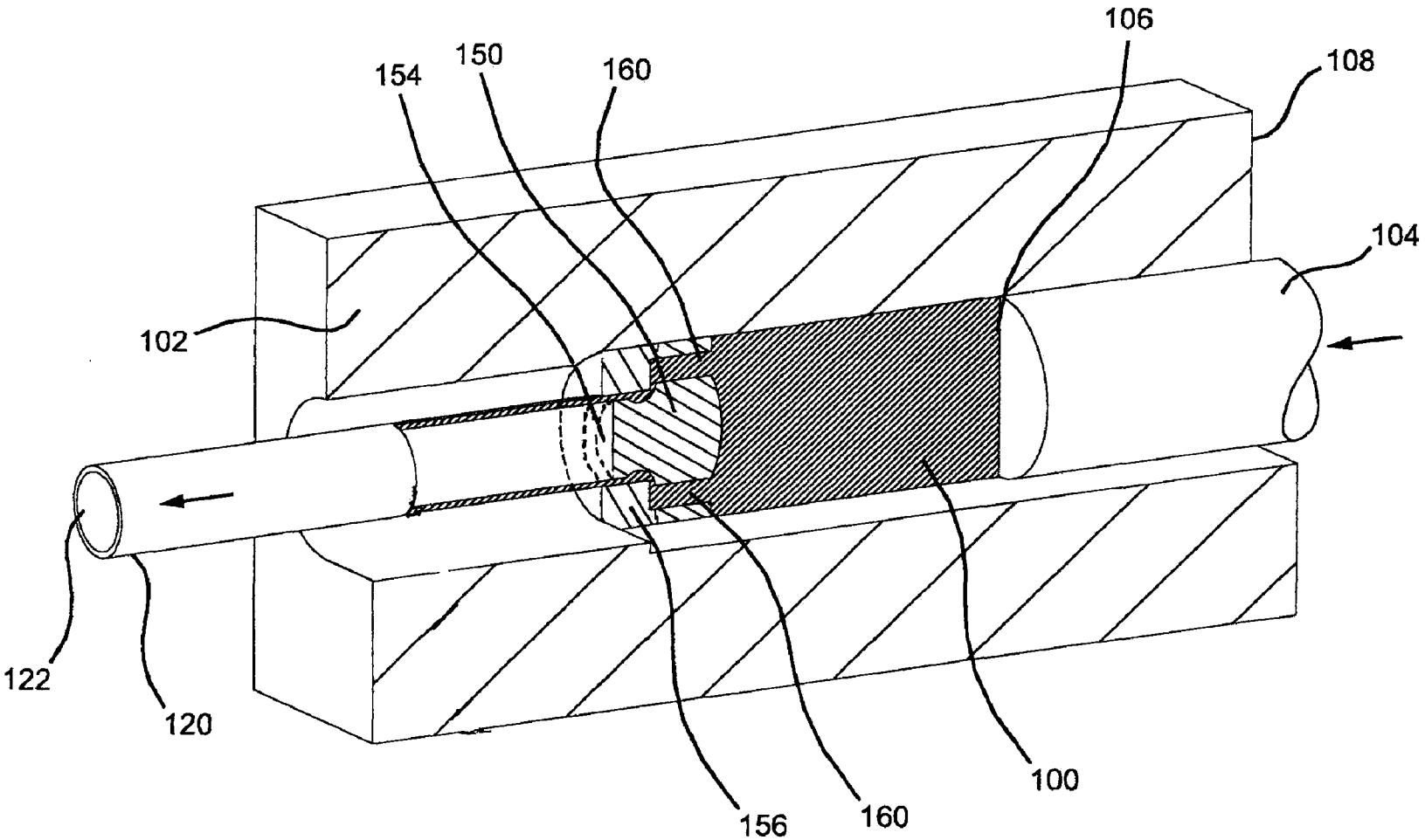
FIG. 8 shows a partial cross-sectional view of a simplified metal direct extruder for forming a tubular component in accordance with certain aspects of the present disclosure having a die and a second alternate embodiment of a bridge die.
Figure 9:
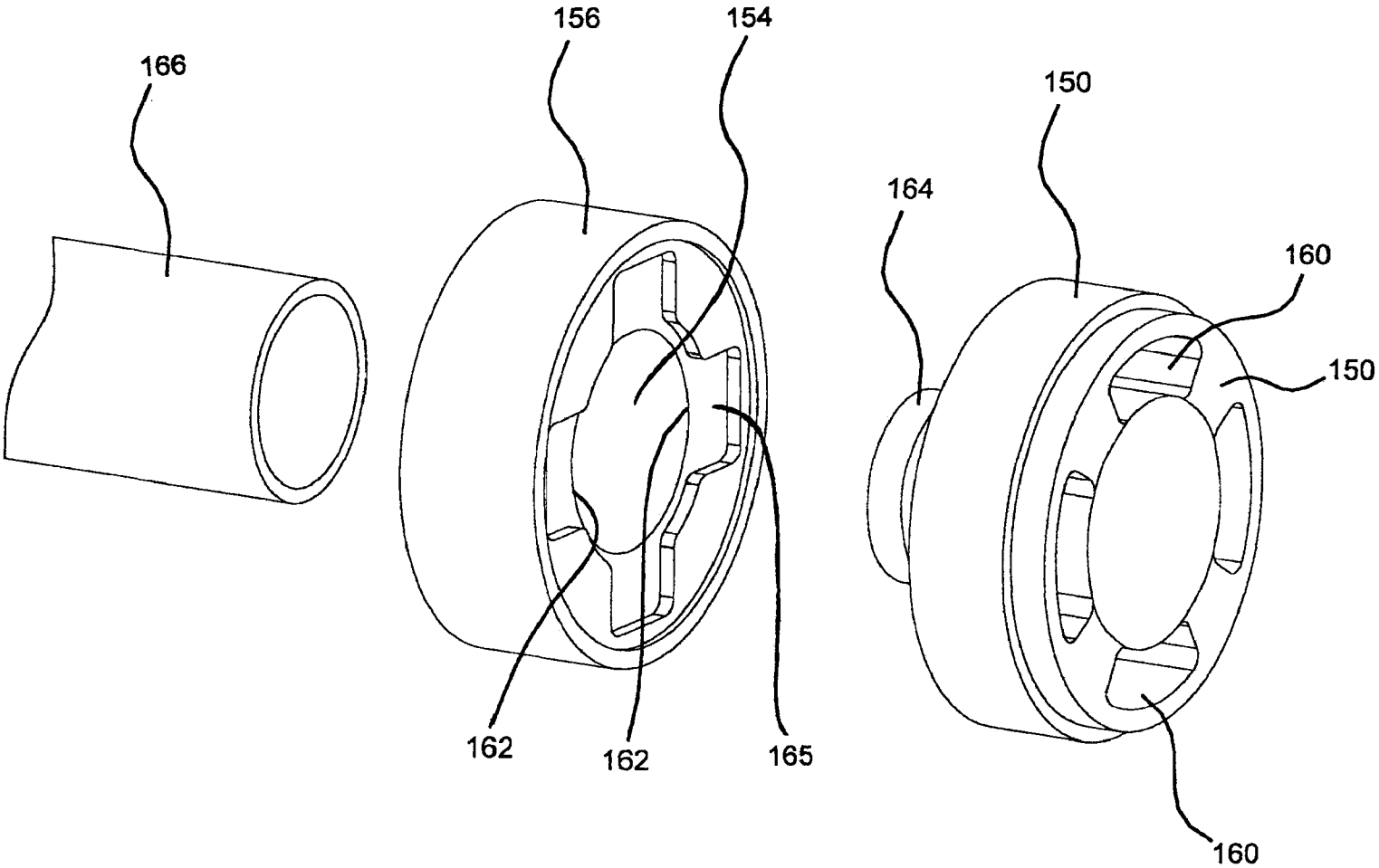
FIG. 9 shows a perspective view of the die and bridge die of FIG. 8.

Another alternate type of bridge die is shown in FIGS. 8 and 9, where the bridge die 150 seats within the die container 102 and interfaces with a complementary orifice 154 in a die 156. The die 156 and bridge die 150 are secured within the die container 102, which is configured similarly to the extrusion apparatus shown in FIG. 7. The bridge die 150 has a shape that forms openings 160 for metal to flow near peripheral ends 162 of the die orifice opening 154. The operating principles of bridge die 150 is similar to that of bridge die 110 shown in FIG. 7, where metal is forced through openings 160 around a solid mandrel region 164 into separate streams and then reunited by a plurality of recessed chambers 165 in the die 156 to form an extruded tubular component 166 having a uniform cross-section and shape. Other methods of forming hollow extruded components are similarly suitable for forming a hollow extruded component in accordance with various aspects of the present disclosure, including by way of example, indirect extrusion. In direct or forward extrusion, such as the extrusion systems shown in FIGS. 7-9, the die and ram are at opposite ends of the billet, where the billet moves relative to the die container, and the extrusion product and ram travel in the same direction. In indirect or backward extrusion, the die is at the ram end of the billet and the extruded product travels in the direction opposite to that of the ram or up through an opening in a hollow ram.

In certain aspects, the extrusion process subjects the metal preform to localized pressure, resulting in significant plastic deformation and localized heat due to friction forces. The plastic deformation promotes beneficial strain hardening in the extruded component, particularly when the extruding is cold-working or cold extrusion below the recrystallization temperature of the alloy. Thus, in various aspects, the methods of the present disclosure extrude a metal preform at an extrusion ratio determined by the following equation (EQN. 1).

$$R = \frac{A_O}{A_F} \qquad \text{(EQN. 1)}$$

Which is a ratio of the original cross-sectional area ($A_O$) to the final cross-sectional area ($A_F$) of the extruded part (see $L_O$ and $L_F$ in FIG. 8). With the extrusion ratio (R), strain ($\epsilon$) can be estimated in an ideal case by EQN. 2

$$\varepsilon = \ln\left(\frac{A_O}{A_f}\right) = \ln R. \qquad \text{(EQN. 2)}$$

By way of example, where a tubular section of 1 inch (2.54 cm) outer-diameter (OD) and 0.5 inch (1.3 cm) inner-diameter (ID) (having a 0.25 inch (0.64 cm) thick wall) is extruded to a section having a 0.5 inch OD (1.3 cm) and 0.2 inch (0.5 cm) ID amounting to a 0.125 inch (0.32 cm) wall, the extrusion ratio R is calculated by dividing the annular area of the 1 inch OD tube, which is 0.589 $in^2$ (found by subtracting 0.196 $in^2$ from 0.79 $in^2$), by the annular area of the 0.5 inch tubular component or 0.147 $in^2$ (0.049 $in^2$ subtracted from 0.196 $in^2$). Thus, the extrusion ratio is about 4 (0.589 $in^2$ divided by 0.147 $in^2$). In various embodiments, an extrusion ratio of greater than or equal to about 4 deforms the bulk of the preform material passing through the die, thus providing greater plastic deformation and strain hardening. Optionally, the extrusion ratio is greater than or equal to about 20, optionally greater than or equal to about 25. In certain aspects, the extrusion ratio is optionally greater than or equal to about 50, optionally greater than or equal to about 100, and in some embodiments, up to about 400. Other factors which impact extrusion include the physical properties of the alloy selected, a die angle (where the billet interfaces with the die), shape factor (for example, a ratio of the perimeter of a shape to cross-sectional area denoting the complexity of the extrusion process), the preform and/or die temperatures, ram or extrusion speed, and/or types of lubricant employed, for example.

Example 1

An alloy according to one aspect of the present disclosure was prepared as follows: 900 kg of melt is prepared and cast into billets having a dimension of 178 mm wide by 406 mm long, the alloy herein identified as "AM30." For purposes of comparison, a prior art alloy sample of the AZ31B alloy is likewise prepared by casting a melt of 900 kg into billets having the same dimensions as the alloy of the present disclosure. Table 1 shows the specifications for the present inventive alloy (AM30) and the prior art alloy (AZ31B), as prepared.

TABLE 1

| Alloy | Al (wt. %) | Mn (wt. %) | Zn (wt. %) | Fe (wt. %) | Ni (wt. %) | Cu (wt. %) | Mg (wt. %) |
|---|---|---|---|---|---|---|---|
| AM30 | 3.4 | 0.33 | 0.16 | 0.0026 | 0.006 | 0.0008 | 96 |
| AZ31B | 3.1 | 0.54 | 1.05 | 0.0035 | 0.007 | 0.0008 | 95 |

The balance of both alloys comprises trace impurities typically found in magnesium alloys. The billets were both heated to 360° C. and tubes were extruded using a 1400 ton press to form tubes having dimensions of a nominal outside diameter of 70 mm and a nominal thickness of 4 mm. For each alloy, a maximum extrusion speed was determined at the onset of surface cracking of the tubes. Approximately 200 meters of tubes were made at the maximum extrusion speed for each alloy.

Figure 2:
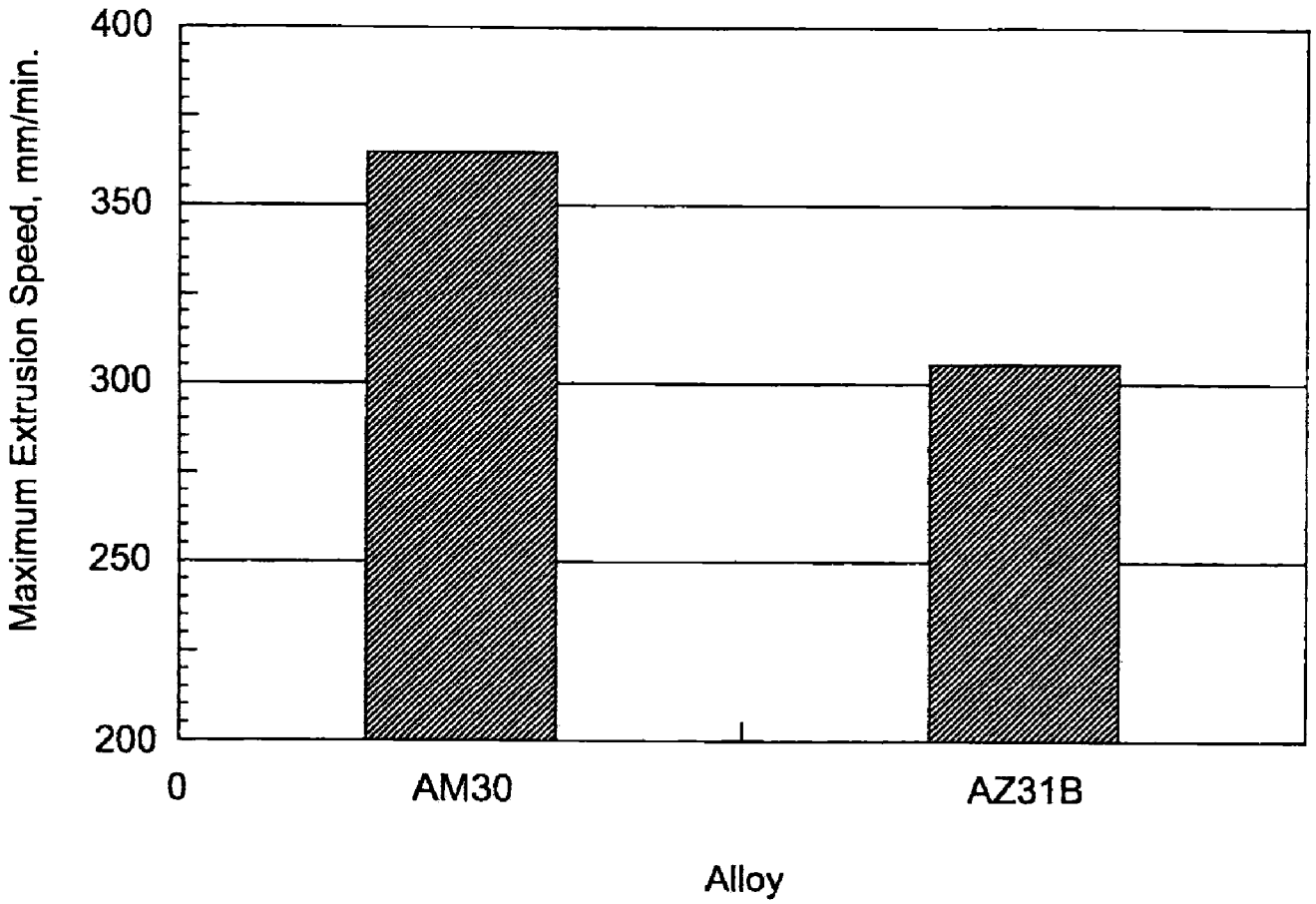
FIG. 2 is a chart showing maximum extrusion speed of an alloy according to the present disclosure (AM30) compared to a prior art alloy (AZ31B)

FIG. 2 shows a comparison of the maximum extrusion ram speeds for the AM30 alloy in accordance with the principles of the present disclosure, versus the prior art AZ31B alloy, conducted at 360° C. The AM30 alloy reached a sustained extrusion speed of 366 mm/min versus the extrusion speed for AZ31B which was 305 mm/min. Thus, the extrusion speed of the new AM30 alloy is 20% faster than the extrusion speed of the fastest previously known wrought magnesium-based alloy (AZ31B) at 360° C.

An important aspect of structural components is that they possess high strength through a variety of conditions. Tensile properties (i.e., tensile yield strength, ultimate tensile strength and ductility as reflected by elongation) were determined by testing performed on the prepared tensile specimens made from extruded tube samples. The tubes samples were machined along the longitudinal axis/direction of the tubes. Only the grip sections of the samples were flattened and the curved gage sections remained intact. Tensile strength testing was then carried out at ambient conditions (i.e., room temperature) and five elevated temperatures: 93° C., 121° C., 149° C., 177° C., and 204° C., per ASTM E21-92 specification for tensile strength testing of wrought alloys. ASTM standard specimens of 2" gauge length were used for tests at an initial strain rate of 0.001 $s^{-1}$ (i.e., 0.001/second). For each condition, at least three specimens were tested and the measured values were averaged.

Figure 3:
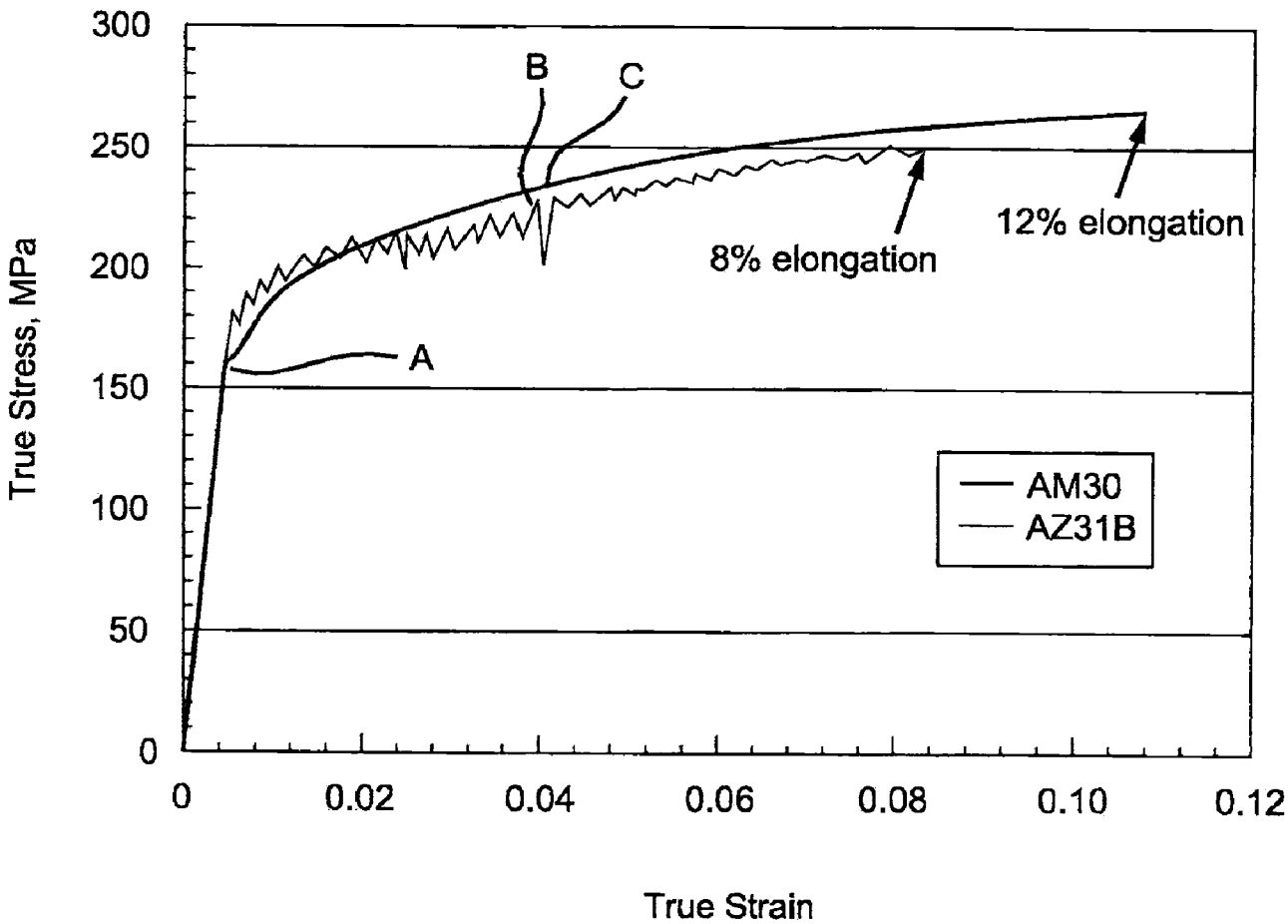
FIG. 3 is a tensile curve graph of true-stress versus true-strain showing comparing an alloy of the present disclosure (AM30) with a prior art alloy (AZ31B) at room temperature.

FIG. 3 shows typical tensile curves for both the extruded tubes formed of AM30 and AZ31B alloys at room temperature. Both of the alloys have similar yield strength (YS) of 168 MPa for AM30 and 171 MPa for AZ31B, as determined by a 0.02 strain offset at A in FIG. 3. The ultimate tensile strength (UTS) for AZ31B is indicated at B as 232 MPa and AM30 is indicated at C as 237 MPa, which are relatively similar. The ductility of both the two alloys is shown by the elongation of the samples, as shown in the tensile curves. AZ31B exhibits an 8% elongation, as where AM30 of the present disclosure exhibits a 12% elongation. Thus, the AM30 alloy of the present disclosure has a 50% greater ductility than the prior art AZ31B at room temperature, while generally having the same strength. FIG. 3 also shows that AZ31B exhibits serrations in the tensile curve, indicating discontinuous plastic flow during deformation. However, such serrations were not observed in the AM30 alloy.

Figure 4:
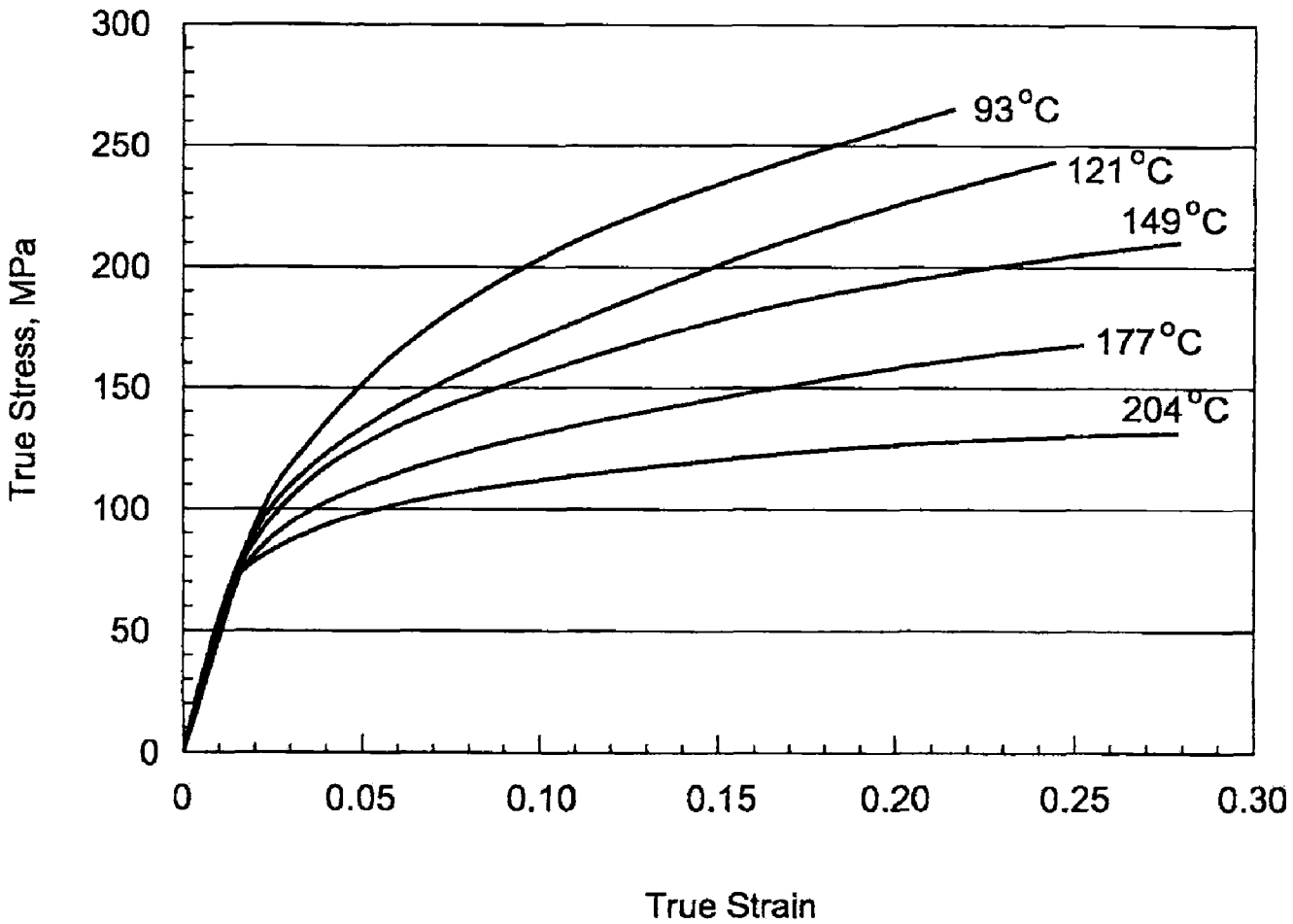
FIG. 4 is a tensile curve graph of an alloy according to the present disclosure (AM30) at elevated temperatures.
Figure 5:
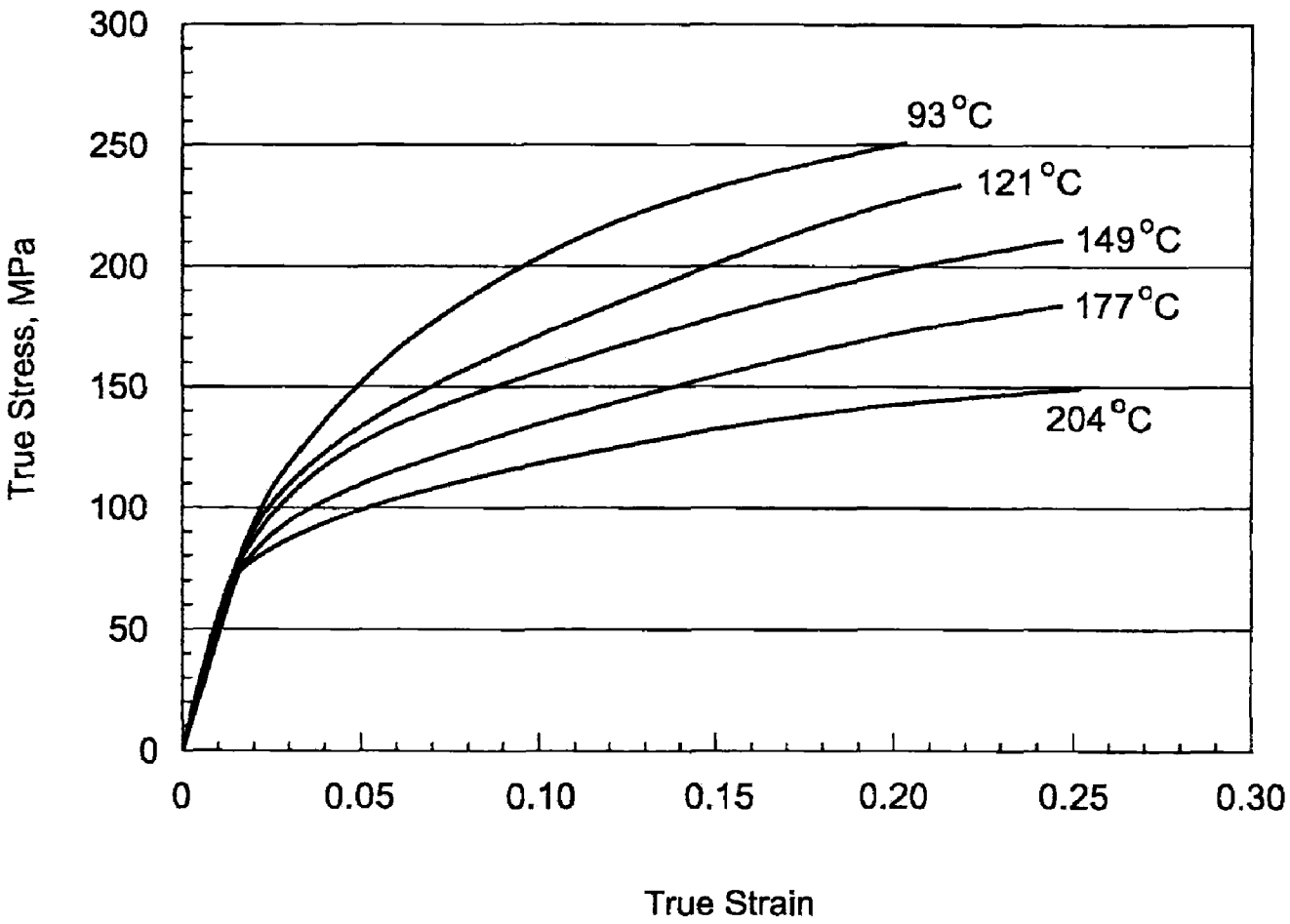
FIG. 5 is a tensile curve graph of a prior art alloy (AZ31B) at elevated temperatures.

FIG. 4 demonstrates the elevated temperature true-stress versus true-strain curves conducted on the specimens described previously for the AM30 alloy of the present disclosure. For the elevated temperature testing, the samples were maintained at the selected temperature for 30 minutes prior to loading. The tensile strength curves are developed for the AM30 specimens at 93° C., 121° C., 149° C., 177° C., and 204° C., respectively. FIG. 5 shows the elevated temperature tensile curves for the prior art AZ31B, at the same temperature increments as that of FIG. 4 at 93° C., 121° C., 149° C., 177° C., and 204° C. In general, both the yield strength (YS) and ultimate tensile strength (UTS) are relatively the same for both alloys, and both properties decrease with increasing temperature.

Figure 6:
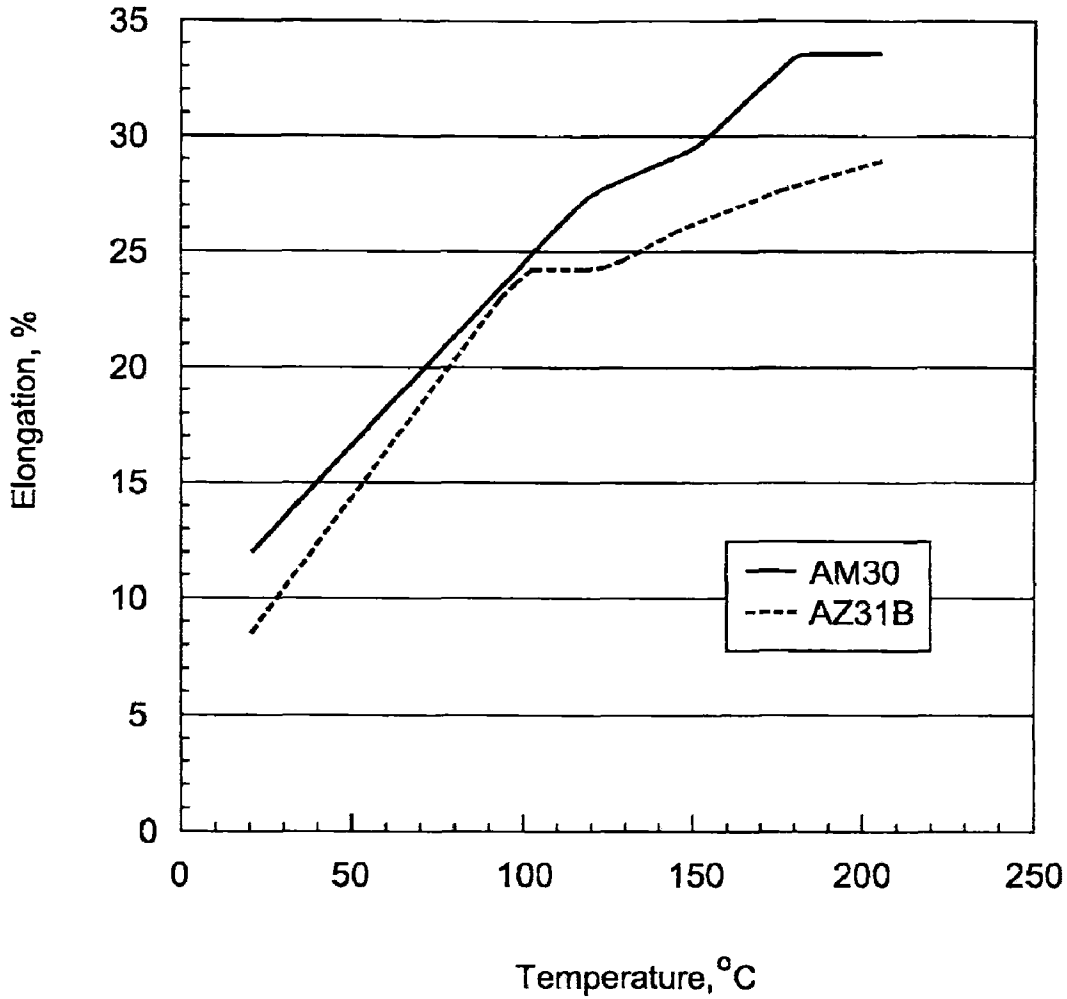
FIG. 6 shows the effect of temperature on elongation of an alloy of the present disclosure (AM30) compared with a prior art alloy (AZ31B)

FIG. 6 shows a comparison of the effect of temperature on the ductility of the AM30 alloy sample of the present disclosure versus the AZ31B sample of the prior art. The percentage elongation, which relates to the ductility of the alloy material, generally increases as temperature increases. The ductility of the AM30 is slightly higher across the range of temperatures tested, and is significantly greater at the upper and lower ends of the temperature range tested (i.e., from a lower range of approximately 25° C. to 70° C. and then at a higher range of about 100° C. to 200° C.). Although not wishing to be bound by any particular theory, it is believed that due to the substantial absence of zinc in the AM30 alloy of the present disclosure, there is less solid solution strengthening (e.g., strength hardening) than in the prior art AZ31B alloy having at least 1 wt. % zinc, which thus provides an increased ductility. As can be observed from the tensile curves, the AM30 alloys and AZ31B alloys generally have the same relationship at room temperature: they both have relatively similar yield strength (YS) and ultimate tensile strength (UTS) to one another, while AM30 exhibits a greater elongation at almost all temperatures which correlates to a greater ductility of the AM30 alloy as compared to AZ31B.

Example 2

Various billets or preforms of magnesium alloys are prepared having the alloy compositions set forth in Table 2 below.

TABLE 2

| Alloy | Al (wt. %) | Mn (wt. %) | Zn (wt. %) | Fe (wt. %) | Ni (wt. %) | Cu (wt. %) | Mg (wt. %) |
|---|---|---|---|---|---|---|---|
| A | 3.05 | 0.30 | 0.16 | 0.0033 | 0.003 | 0.0004 | Balance |
| B | 3.08 | 0.24 | 0.27 | 0.0028 | 0.002 | 0.0004 | Balance |
| C | 3.06 | 0.25 | 0.55 | 0.0045 | 0.003 | 0.0003 | Balance |
| D | 2.94 | 0.20 | 0.92 | 0.0060 | 0.002 | 0.0002 | Balance |
| E | 2.89 | 0.22 | 1.09 | 0.0055 | 0.002 | 0.0003 | Balance |

A plurality of billets is formed having compositions set forth in Table 2 as Alloys A-E having a diameter of 105 mm. The billets are heated to 360° C. and extruded using an 800 ton press to form tubes having dimensions of a nominal outside diameter of 40 mm and a nominal thickness of 3 mm. For each alloy, a maximum extrusion speed is determined at the onset of surface cracking of the tubes. Approximately 50 meters of tubes are made at the maximum extrusion speed for each alloy (i.e., Alloys A-E).

Figure 10:
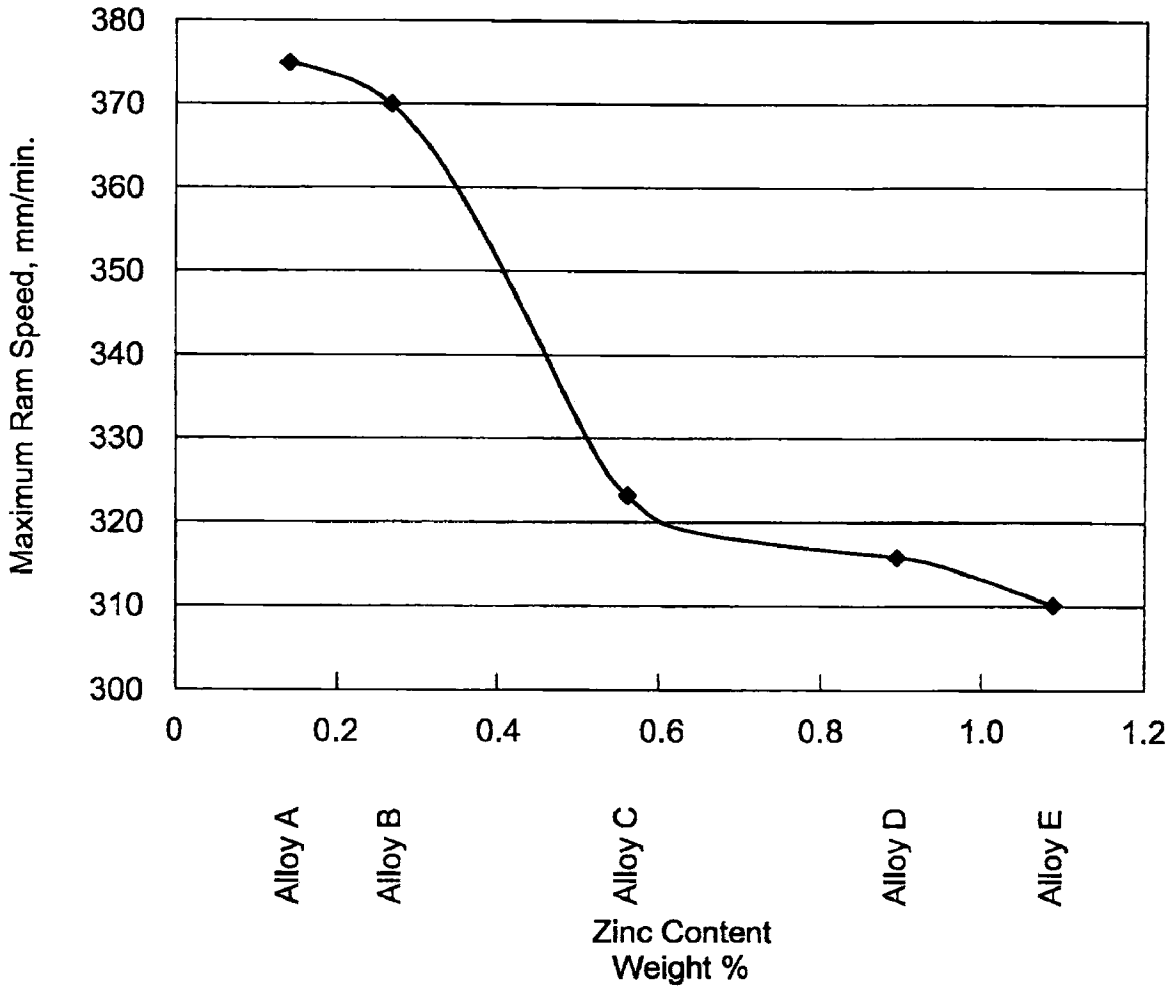
FIG. 10 shows the effect of zinc (Zn) content on the maximum extrusion ram speeds conducted at 360° C. for five experimental magnesium-based alloys in accordance with the principles of the present disclosure.

FIG. 10 shows the affect of Zn content on the maximum extrusion ram speeds for the experimental Alloys A-E conducted at 360° C. The results show an unexpectedly significant improvement in maximum extrusion speed when Zn content is minimized, preferably below about 0.2% (Alloy A). Thus, as described above, processes of the present teachings preferably employ a magnesium alloy that has Zn present at less than an impurity level, optionally less than 0.22 wt. %, optionally less than or equal to about 0.2 wt. %, preferably at less than or equal to about 0.18 wt. %, and optionally less than or equal to about 0.16 wt. %. The data further confirms that the AM30 alloy (with Zn below 0.2% as an impurity) is at least about 20% faster than the extrusion speed of the fastest previously known wrought magnesium-based alloy (AZ31B) at 360° C. Further, the lower the impurity level of zinc in the magnesium-based alloys, the faster the extrusion speed possible.

Example 3

In Example 3, a commercially available AM20 casting alloy (Alloy designated Control 1 in Table 3 below) is compared with the various inventive alloys (Alloys F, G, and H having varying aluminum content as set forth in Table 3).

TABLE 3

| Alloy | Al (wt. %) | Mn (wt. %) | Zn (wt. %) | Fe (wt. %) | Ni (wt. %) | Cu (wt. %) | Mg (wt. %) |
|---|---|---|---|---|---|---|---|
| Control 1 | 2 | 0.30 | 0.22 | 0.0033 | 0.003 | 0.0004 | Balance |
| F | 2.5 | 0.30 | 0.22 | 0.0033 | 0.003 | 0.0004 | Balance |
| G | 3.05 | 0.30 | 0.22 | 0.0033 | 0.003 | 0.0004 | Balance |
| H | 3.5 | 0.30 | 0.22 | 0.0033 | 0.003 | 0.0004 | Balance |

A plurality of billets is formed having compositions set forth in Table 3, with either the composition of Control 1 or Alloys F-H. The billets have a diameter of about 105 mm. The billets are heated to 360° C. and tubes are extruded using an 800 ton press to form tubes having dimensions of a nominal outside diameter of 40 mm and a nominal thickness of 3 mm.

Figure 11:
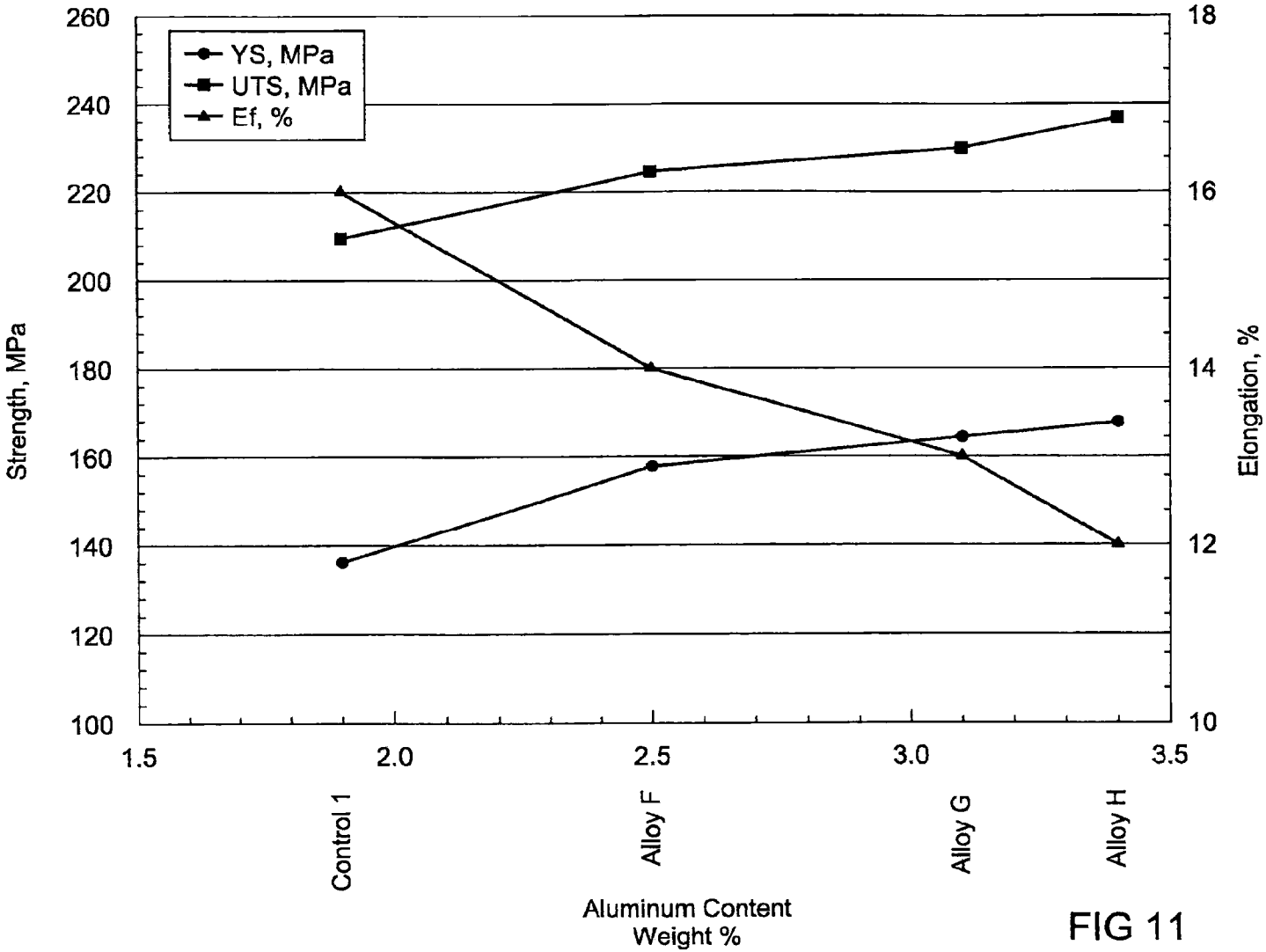
FIG. 11 shows the effect of aluminum (Al) content on tensile properties of magnesium-based alloy extruded tube components.

Tensile strength curves were developed for Control 1 as compared to Alloys F-H at room temperature (approximately 26° C.). FIG. 11 shows the respective elongation %, yield strength (YS), and ultimate yield strength (UTS) for the different alloys. As shown in FIG. 11, extruded tubes formed of Control 1 (AM20 with 2% aluminum) have a yield strength of only about 135 MPa. However, alloys having an aluminum content of about 2.5 to about 3.5%-Alloys F-H) have a yield strength of greater than about 150 MPa. In automotive structural applications, extruded components generally require high strength, as reflected in high yield strength of at least about 150 MPa. Similarly, Alloys F-H have a UTS of above 220 MPa, while Control 1 has a UTS of about 210 MPa. However, elongation of Alloys F-H is between about 12 and 14% at room temperature, as where aluminum content of Control 1 at about 2% provides an elongation of greater than about 14%. It should be noted that the inventive alloys provide desirable strength reflected by a YS of greater than or equal to about 150 MPa and a UTS of greater than or equal to about 210 MPa at room temperature, while optimizing the elongation to be above greater than or equal to about 11%, optionally greater than or equal to about 12%, and in certain aspects greater than or equal to about 13% at room temperature to provide adequate ductility. Therefore, in certain aspects, the alloy chemistry of the inventive alloys is preferred for methods of extruding structural components to result in desired strength and processing characteristics.

The strength (YS and/or UTS) gained by increasing the aluminum content from about 3% to about 3.5% in the inventive compositions does not provide significant strength benefits and further reduces elongation. Generally, increasing aluminum content above about 4 to 5 wt. % makes the alloy more difficult to subsequently work and extrude, due to an increased hardness. Thus, in certain aspects, the alloys used for forming extruded components in accordance with the present disclosure have an aluminum content of approximately 3%, such as in representative Alloy G.

The present disclosure further provides a method of forming a wrought alloy element comprising forming an alloy material having a composition comprising aluminum (Al) of less than about 4.0 wt. %, preferably greater than or equal to about 2.5 wt. % and less than or equal to about 3.5 wt. %; manganese (Mn) of less than 0.6 wt. %; zinc (Zn) of less than an impurity level of about 0.22 wt. %; one or more impurities other than zinc at less than about 0.1 wt. %; and a balance of magnesium (Mg) at a casting temperature. The casting temperature is generally above the liquidus temperature of the alloy, but is at least at the point where the metal is molten and is in a substantially liquid-state. It is preferred that the casting temperature is greater than 600° C., most preferably greater than 640° C. The alloy material is cooled to solidify and in certain aspects, the alloy material is cooled to ambient conditions. The solidified alloy material is processed by extruding, thereby forming the wrought extruded alloy element.

In various aspects, the present disclosure provides a method of forming an extruded structural component that comprises extruding a magnesium alloy material through a die orifice. In certain aspects, the extruding forms a tubular component. In certain aspects, the extruding further comprises passing the magnesium alloy material through a die bridge and then through a die orifice. The magnesium alloy material is capable of an extrusion speed of greater than or equal to about 305 mm per minute at about 360° C. Further, the alloy material has a composition comprising aluminum (Al) at about 2.5 to about 3.5 wt. %; manganese (Mn) at about 0.2 to about 0.6 wt. %; zinc (Zn) less than an impurity level of 0.22 wt. %; one or more impurities other than zinc collectively less than about 0.1 wt. %; and a balance of magnesium (Mg). The extruding forms the extruded structural component, which has a yield strength of at least about 150 MPa and an elongation of greater than or equal to about 10% at room temperature.

In other aspects, the present teachings provide a method of forming an extruded structural component comprising extruding a magnesium alloy material through a die orifice. In certain aspects, the extruding forms a tubular component. In certain aspects, the extruding further comprises passing the magnesium alloy material through a die bridge and then through a die orifice. The magnesium alloy material is capable of an extrusion speed of greater than or equal to about 305 mm per minute at about 360° C. and the alloy has a composition comprising aluminum (Al) at about 2.5 to about 3.5 wt. %; manganese (Mn) at about 0.2 to about 0.6 wt. %; zinc (Zn) at less than an impurity level of about 0.22 wt. %; one or more impurities other than zinc collectively less than about 0.1 wt. %; and a balance of magnesium (Mg) to form the extruded structural component. The method forms an extruded structural component that has an ultimate tensile strength greater than or equal to about 230 MPa and a yield strength of greater than or equal to about 150 MPa at room temperature. In certain aspects, the extruding is cold extrusion conducted at a temperature less than a recrystallization temperature of the magnesium alloy material and the extruding results in strain hardening of the extruded structural component.

In yet other aspects of the present disclosure, a method is provided for forming an extruded structural component comprising extruding a magnesium alloy material preform having a first diameter through a die orifice with a second diameter that is less than the first diameter at an extrusion ratio of greater than or equal to about 4. The alloy material preform is at a temperature of less than or equal to about 200° C. and is capable of an extrusion speed of greater than or equal to about 305 mm per minute at about 360° C. The alloy composition comprises aluminum (Al) at about 2.5 to about 3.5 wt. %; manganese (Mn) at about 0.2 to about 0.6 wt. %; zinc (Zn) at less than an impurity level of about 0.22 wt. %; one or more impurities other than zinc collectively less than about 0.1 wt. %; and a balance of magnesium (Mg) to form the extruded structural component having the second diameter. Further, the extruded structural component has a yield strength of at least about 150 MPa, and an elongation of greater than 12% at room temperature.

The present disclosure is particularly well-suited for automotive components and parts. Certain preferred automotive parts comprise a wrought alloy according to the present disclosure formed into an extruded tubular structure.

A method of forming an extruded tubular automobile component comprising extruding a magnesium alloy material through a reduced diameter die orifice having a shape that forms a tubular component for use in an automobile at an extrusion ratio greater than or equal to about 4. The magnesium alloy material is capable of an extrusion speed of greater than or equal to about 305 mm per minute at about 360° C. The alloy material has a composition comprising aluminum (Al) of about 3.0 wt. %; manganese (Mn) at about 0.2 to about 0.6 wt. %; zinc (Zn) less than an impurity level of about 0.18 wt. %; one or more impurities other than zinc collectively less than about 0.1 wt. %; and a balance of magnesium (Mg) to form the extruded tubular automotive structural component having a yield strength of at least about 150 MPa, an ultimate tensile strength of at least about 230 MPa, and an elongation of greater than 12% at room temperature. In various aspects, the tubular automobile component forms an automotive part selected from the group consisting of frames, support members, cross-members, instrument panel beams, roof rails, engine cradles, transfer cases, steering components, and combinations thereof.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. A method of forming an extruded structural component comprising:

extruding a magnesium alloy material through a die orifice, wherein said magnesium alloy material is capable of an extrusion speed of greater than or equal to about 305 mm per minute at about 360° C., wherein said alloy material has a composition comprising aluminum (Al) at about 2.5 to about 3.5 wt. %; manganese (Mn) at about 0.2 to about 0.6 wt. %; zinc (Zn) less than an impurity level of 0.22 wt. %; one or more trace impurities other than zinc (Zn) collectively less than about 0.1 wt. %, including strontium (Sr) at less than an impurity level of 0.02 wt. %; and a balance of magnesium (Mg) to form the extruded structural component having a yield strength of at least about 150 MPa and an elongation of greater than or equal to about 10% at room temperature.

2. The method of claim 1, wherein said extruding further comprises passing said magnesium alloy material through a die bridge prior to said magnesium alloy material passing through said die orifice.

3. The method of claim 1, wherein said extruding forms a tubular component.

4. The method of claim 1, wherein said aluminum is about 2.75 to about 3.25 wt. % of the composition.

5. The method of claim 1, wherein said aluminum is about 3 wt. % of the composition.

6. The method of claim 1, wherein said composition comprises said zinc (Zn) at less or equal to about 0.18 wt. % of the composition.

7. The method of claim 1, wherein said composition comprises said zinc (Zn) at less or equal to about 0.16 wt. % of the composition.

8. The method of claim 1, wherein said one or more trace impurities other than zinc (Zn) comprise: silicon (Si) of less than about 0.01 wt. %, copper (Cu) of less than about 0.01 wt. %, nickel (Ni) of less than about 0.002 wt. %, iron (Fe) of less than about 0.002 wt. %, strontium (Sr) of less than about 0.02 wt. %, and one or more additional trace impurities of less than about 0.02 wt. % of the composition.

9. The method of claim 1, wherein the alloy has an elongation of greater than or equal to about 12% at room temperature.

10. The method of claim 1, wherein the alloy has a yield strength of greater than about 165 MPa.

11. The method of claim 1, wherein the alloy has an ultimate tensile strength of greater than about 230 MPa.

12. The method of claim 1, wherein an extrusion ratio of said extruding is greater than or equal to about 4.

13. The method of claim 1, wherein said extruding is cold extrusion conducted at a temperature less than a recrystallization temperature of said magnesium alloy material and said extruding results in strain hardening of said extruded structural component.

14. A method of forming an extruded structural component comprising:

extruding a magnesium alloy material through a die orifice, wherein said magnesium alloy material is capable of an extrusion speed of greater than or equal to about 305 mm per minute at about 360° C., wherein said alloy material has a composition comprising aluminum (Al) at about 2.5 to about 3.5 wt. %; manganese (Mn) at about 0.2 to about 0.6 wt. %; zinc (Zn) at less than an impurity level of about 0.22 wt. %; one or more trace impurities other than zinc (Zn) collectively less than about 0.1 wt. %, including strontium (Sr) at less than an impurity level of 0.02 wt. %; and a balance of magnesium (Mg) to form the extruded structural component having an ultimate tensile strength greater than or equal to about 230 MPa and a yield strength of greater than or equal to about 150 MPa at room temperature.

15. The method of claim 14, wherein said extruding further comprises passing said magnesium alloy material through a die bridge prior to said magnesium alloy material passing through said die orifice.

16. The method of claim 14, wherein said aluminum is about 2.75 to about 3.25 wt. % of the composition.

17. The method of claim 14, wherein said aluminum is about 3 wt. % of the composition.

18. The method of claim 14, wherein said composition comprises said zinc (Zn) at less or equal to about 0.18 wt. % and said one or more impurities other than zinc (Zn) comprise: silicon (Si) of less than about 0.01 wt. %, copper (Cu) of less than about 0.01 wt. %, nickel (Ni) of less than about 0.002 wt. %, iron (Fe) of less than about 0.002 wt. %, strontium (Sr) of less than about 0.02 wt. %, and one or more additional trace impurities of less than about 0.02 wt. % of the composition.

19. The method of claim 14, wherein the alloy has an elongation of greater than or equal to about 12% at room temperature.

20. The method of claim 14, wherein an extrusion ratio of said extruding is greater than or equal to about 4.

21. The method of claim 14, wherein said extruding is cold extrusion conducted at a temperature less than a recrystallization temperature of said magnesium alloy material and said extruding results in strain hardening of said extruded structural component.

22. A method of forming an extruded structural component comprising:

extruding a magnesium alloy material preform having a first diameter through a die orifice with a second diameter that is less than said first diameter at an extrusion ratio of greater than or equal to about 4, wherein said alloy material preform is at a temperature of less than or equal to about 200° C., is capable of an extrusion speed of greater than or equal to about 305 mm per minute at about 360° C., and has a composition comprising aluminum (Al) at about 2.5 to about 3.5 wt. %; manganese (Mn) at about 0.2 to about 0.6 wt. %; zinc (Zn) at less than an impurity level of about 0.22 wt. %; one or more trace impurities other than zinc (Zn) collectively less than about 0.1 wt. %, including strontium (Sr) at less than an impurity level of 0.02 wt. %; and a balance of magnesium (Mg) to form the extruded structural component having said second diameter, a yield strength of at least about 150 MPa, and an elongation of greater than 10% at room temperature.

23. A method of forming an extruded tubular automobile component comprising:

extruding a magnesium alloy material through a reduced diameter die orifice having a shape that forms a tubular component for use in an automobile at an extrusion ratio greater than or equal to about 4, wherein said magnesium alloy material is capable of an extrusion speed of greater than or equal to about 305 mm per minute at about 360° C., wherein said alloy material has a composition comprising aluminum (Al) of about 3.0 wt. %; manganese (Mn) at about 0.2 to about 0.6 wt. %; zinc (Zn) less than an impurity level of about 0.18 wt. %; one or more trace impurities other than zinc (Zn) collectively less than about 0.1 wt. %, including strontium (Sr) at less than an impurity level of 0.02 wt. %; and a balance of magnesium (Mg) to form the extruded tubular automotive structural component having a yield strength of at least about 150 MPa, an ultimate tensile strength of at least about 230 MPa, and an elongation of greater than 12% at room temperature.

24. The method of claim 23, wherein said tubular automobile component forms an automotive part selected from the group consisting of frames, support members, cross-members, instrument panel beams, roof rails, engine cradles, transfer cases, steering components, and combinations thereof.

* * * * *